US008774676B2

(12) United States Patent
Abe

(10) Patent No.: US 8,774,676 B2
(45) Date of Patent: Jul. 8, 2014

(54) IMAGE FORMING DEVICE AND PROCESS UNIT

(75) Inventor: Koji Abe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 212 days.

(21) Appl. No.: 13/359,650

(22) Filed: Jan. 27, 2012

(65) Prior Publication Data

US 2012/0219320 A1 Aug. 30, 2012

(30) Foreign Application Priority Data

Feb. 25, 2011 (JP) ..... 2011-040212

(51) Int. Cl.
*G03G 21/18* (2006.01)

(52) U.S. Cl.
USPC ..... 399/111; 399/116; 399/117

(58) Field of Classification Search
USPC ..... 399/111, 116, 117
See application file for complete search history.

(56) References Cited

U.S. PATENT DOCUMENTS 6,381,429 B1 4/2002 Shibata et al.
7,970,311 B2 * 6/2011 Nakamura et al. ..... 399/109
8,326,179 B2 * 12/2012 Hashimoto ..... 399/117
2009/0169235 A1 * 7/2009 Kamimura ..... 399/98
2009/0220275 A1 9/2009 Hashimoto
2010/0135697 A1 * 6/2010 Hashimoto ..... 399/117

FOREIGN PATENT DOCUMENTS

JP H10-337929 A 12/1998
JP 2001-209272 A 8/2001
JP 2001-248656 9/2001
JP 2003-076249 3/2003
JP 2004-361719 12/2004
JP 2009-210630 9/2009
JP 2010-128341 A 6/2010

OTHER PUBLICATIONS

JP Office Action mailed Mar. 26, 2013, JP Appln. 2011-040212, English translation.

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A process unit includes: a photosensitive drum defining a first direction parallel to an axial direction of the photosensitive drum, and including: a tubular body having a first end portion containing a distal end; and a fitting member un-rotatably provided at the first end portion; a bearing member rotatably supporting the fitting member at a position inward from the distal end in the first direction; and a side plate configured to un-rotatably support the bearing portion.

12 Claims, 10 Drawing Sheets

(a)

36R(36)

(b)

36L(36)

36R(36)

(a)

36R(36)

(b)

36L(36)

IMAGE FORMING DEVICE AND PROCESS UNIT

CROSS REFERENCE TO RELATED APPLICATION

This application claims priority from Japanese Patent Application No. 2011-040212 filed Feb. 25, 2011. The entire content of the priority application is incorporated herein by reference.

TECHNICAL FIELD

The present invention relates to a process unit to be loaded on an image forming device such as a laser printer, and to the image forming unit provided with the process unit.

BACKGROUND

A tandem type color printer is known as an electro-photographic type color printer in which a plurality of photosensitive drums corresponding to colors of yellow, magenta, cyan and black are juxtaposed or arrayed side by side. Japanese Patent Application Publication No. 2009-210630 discloses such a color printer having a drum unit holding the four photosensitive drums and detachable from and attachable to a main casing. The drum unit includes a pair of side plates supporting each photosensitive drum therebetween and spaced away from each other in an axial direction of each photosensitive drum, the axial direction being rightward/leftward or lateral direction of the printer. Each drum body of each photosensitive drum is pressed by each developing roller.

A fitting member is fitted with each lateral end portion of each photosensitive drum such that the fitting member is not rotatable relative to the photosensitive drum. Each side plate is formed with drum support holes, and each photosensitive drum is rotatably supported to each drum support hole through a bearing member that is fitted over the fitting member. Driving force from the main casing is applied to each left end portion of each left side fitting member for driving each photosensitive drum.

More specifically, the fitting member has a laterally inner end portion inserted into a drum body of the photosensitive drum, and has a laterally outer end portion rotatably supported to the drum support hole through the bearing member. That is, in the fitting member, a portion inserted into the drum body is distant from a portion supported by the bearing member in the lateral direction, i.e., these two portions are different from each other in the lateral direction.

SUMMARY

The present inventor found that, as a result of pressure contact between the developing roller and the photosensitive drum, the laterally inner end portion of the fitting member may be displaced from the laterally outer end portion thereof toward a downstream side in a direction of pressing the developing roller to the photosensitive drum. Thus, an axis of the drum body may be displaced from an axis of the fitting member toward the downstream side. Due to the displacement, accurate rotation of the drum body cannot be performed.

It is therefore an object of the present invention to provide a process unit capable of stably supporting the drum body of the photosensitive drum for realizing a stabilized rotation thereof, and to provide an image forming device provided with such process unit.

In order to attain the above and other objects, the invention provides a process unit including: a photosensitive drum defining a first direction parallel to an axial direction of the photosensitive drum, and comprising: a tubular body having a first end portion containing a distal end; and a fitting member un-rotatably provided at the first end portion; a bearing member rotatably supporting the fitting member at a position inward from the distal end in the first direction; and a side plate configured to un-rotatably support the bearing member.

Another aspect of the present invention provides an image forming device including the process unit.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, preferred embodiments of the present invention will be described while referring to the accompanying drawings.

1. Entire Structure of Color Printer

Figure 1:
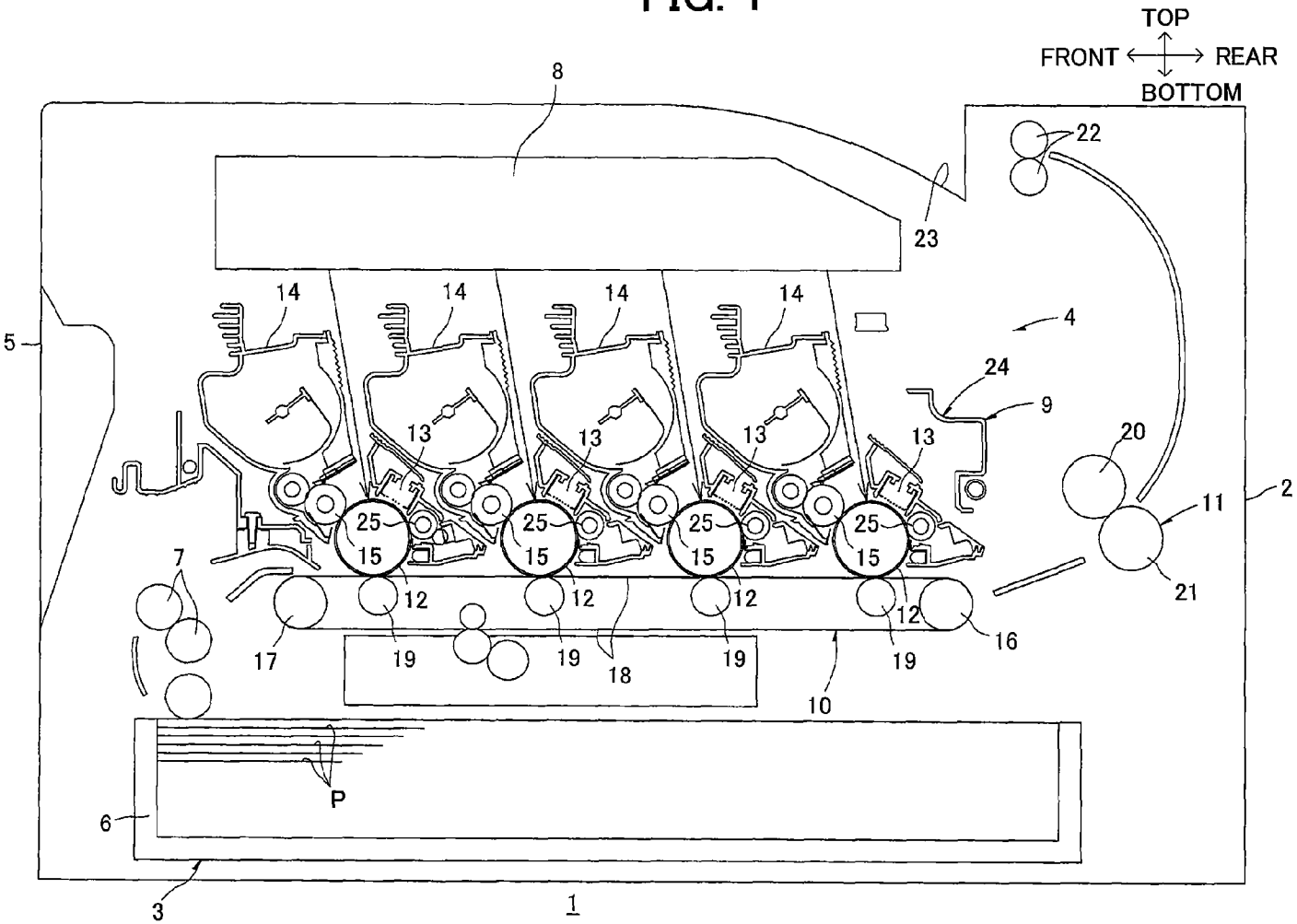
FIG. 1 is a cross-sectional view of a color printer that is one example of the image forming device according to a first embodiment of the present invention.

As shown in FIG. 1, a printer 1 that is one example of an image forming device of the present invention is a direct type of tandem color printer that is laterally disposed. The printer 1 includes a main casing 2, a feeding unit 3 for feeding papers P, and an image-forming unit 4 for forming images on the papers P.

(1) Main Casing

The main casing 2 is a box having a rectangular shape in a side view for accommodating the feeding unit 3 and the image-forming unit 4. A front cover 5 for exposing the internal space of the main casing 2 is provided on one side surface of the main casing 2. The front cover 5 is pivotably openable about a bottom portion thereof.

In the following description, the side of the main casing 2 on which the front cover 5 is provided (the left side in FIG. 1) will be referred to as the "front side," while the opposite side (the right side in FIG. 1) will be referred to as the "rear side." The left and right sides of the main casing 2 will be based on the perspective of a user facing the front side of the printer 1.

(2) Feeding Unit

A sheet tray 6 for accommodating papers P is disposed in a bottom section of the main casing 2.

The papers P accommodated in the sheet tray 6 are fed toward between a pair of registration rollers 7 positioned at an upper-front section of the sheet tray 6 one by one, and are sequentially conveyed toward the image-forming unit 4 (positioned between a photosensitive drum 12 (described later) and a conveying belt 18 (described later)) at a predetermined timing.

(3) Image-Forming Unit

The image-forming unit 4 includes a scanner unit 8, a process unit 9, a transfer unit 10, and a fixing unit 11.

(3-1) Scanner Unit

The scanner unit 8 is disposed in an upper section of the main casing 2. As shown in a solid line of FIG. 1, the scanner unit 8 irradiates four laser beams toward four photosensitive drums 12 (described later) to expose the four photosensitive drums 12 based on image data.

(3-2) Process Unit (3-2-1) Structure of Process Unit

The process unit 9 is disposed below the scanner unit 8 and above the transfer unit 10, and includes a drum unit 24 and four developing units 14.

The drum unit 24 includes the four photosensitive drums 12, four Scorotron chargers 13 and four drum cleaning rollers 25 corresponding to the cleaning member of the present invention.

Each photosensitive drum 12 has a cylindrical shape extending in the leftward/rightward direction. The four photosensitive drums 12 are arranged parallel to each other and are spaced at equal intervals in the frontward/rearward direction.

Each Scorotron charger 13 is disposed at the upper-rear side of the corresponding photosensitive drum 12 and is spaced from the corresponding photosensitive drum 12 at a predetermined interval.

Each cleaning roller 25 is disposed at a rear-top side of the corresponding photosensitive drum 12 and contacts the corresponding photosensitive drum 12.

Each developing unit 14 is disposed above the corresponding photosensitive drum 12, and includes a developing roller 15 corresponding to the developing agent carrying member of the present invention.

Each developing roller 15 is disposed at a bottom section of the corresponding developing unit 14 and is rotatably supported. The rear side of each developing roller 15 is exposed so as to press the corresponding photosensitive drum 12 toward the rear-bottom side.

The four photosensitive drums 5 correspond to the four colors black, yellow, magenta, and cyan. Each developing unit 14 accommodates toners corresponding to each color in an upper space above the developing roller 15.

(3-2-2) Operation in Process Unit

Toners accommodated in each developing unit 14 are carried on a surface of each developing roller 15 in accordance with the rotation of the developing roller 15.

A surface of the each photosensitive drum 12 is uniformly charged by the corresponding Scorotron charger 13 as each photosensitive drum 12 rotates. Then, the surface of each photosensitive drum 12 is exposed by a high speed scanning of the scanner unit 8. Thus, an electrostatic latent image corresponding to an image to be formed on the paper P is formed on the surface of each photosensitive drum 12.

As the photosensitive drum 12 further rotates, the tonners carried on each developing roller 15 are supplied onto the electrical latent image. Thus, the electrical latent image formed on the surface of the photosensitive drum 12 is developed into a visible toner image.

(3-3) Transfer Unit

The transfer unit 10 extends in the frontward/rearward direction and is disposed above the sheet tray 6 and below the process unit 9 in the main casing 2. The transfer unit 10 includes a drive roller 16, a follower roller 17, an endless belt 18, and four transfer rollers 19.

The drive roller 16 and the follower roller 17 are in confrontation with each other in the frontward/rearward direction and spaced at a predetermined interval.

The endless belt 18 is disposed below the photosensitive drums 12, and the upper portion of the endless belt 18 contacts the photosensitive drums 12. The endless belt 18 is mounted on the drive roller 16 and the follower roller 17 in a taut state. The endless belt 18 circularly moves in accordance with the rotation of the drive roller 16 so that the upper portion of the endless belt 18 contacting the photosensitive drums 12 moves from front to rear.

The four transfer rollers 19 are disposed within an internal space formed by the endless belt 18 such that the endless belt 18 is nipped between each transfer roller 19 and the corresponding photosensitive drum 12.

The paper P supplied from the feeding unit 3 passes thorough transfer points formed between each photosensitive drum 12 and the corresponding transfer roller 19 from front to rear in accordance with the circularly movement of the endless belt 18. Thus, the toner image formed on the photosensitive surface of each photosensitive drum 12 is sequentially superimposed and transferred onto the paper P, thereby a color image being formed on the paper P.

Sometimes, toners remain on the surface of the photosensitive drum 12 after the toner image is transferred onto the paper P from the photosensitive drum 12. However, the residual toners are transferred and held on a peripheral surface of the drum cleaning rollers 25 due to a cleaning bias applied to the drum cleaning rollers 25, when the residual toners are opposed to the cleaning roller 25 in accordance with the rotation of the photosensitive drums 12.

(3-4) Fixing Unit

The fixing unit 11 is provided on an upper-rear side of the conveying belt 18. The fixing unit 11 is provided with a heat roller 20 and a pressure roller 12 that is pressed to contact the heat roller 20. The toner images transferred onto the paper P are fixed to the paper P by heat and pressure in the fixing unit 11 when the paper P passes through a position between the heat roller 20 and the pressure roller 12.

(4) Discharge Paper

The toner images fixed on the paper P in the fixing unit 13 are conveyed by various discharge rollers 22 through a U-turn path (not shown), and discharged onto a discharge tray 23 formed on the top surface of the main casing 2.

2. Drum Unit

Figure 2:
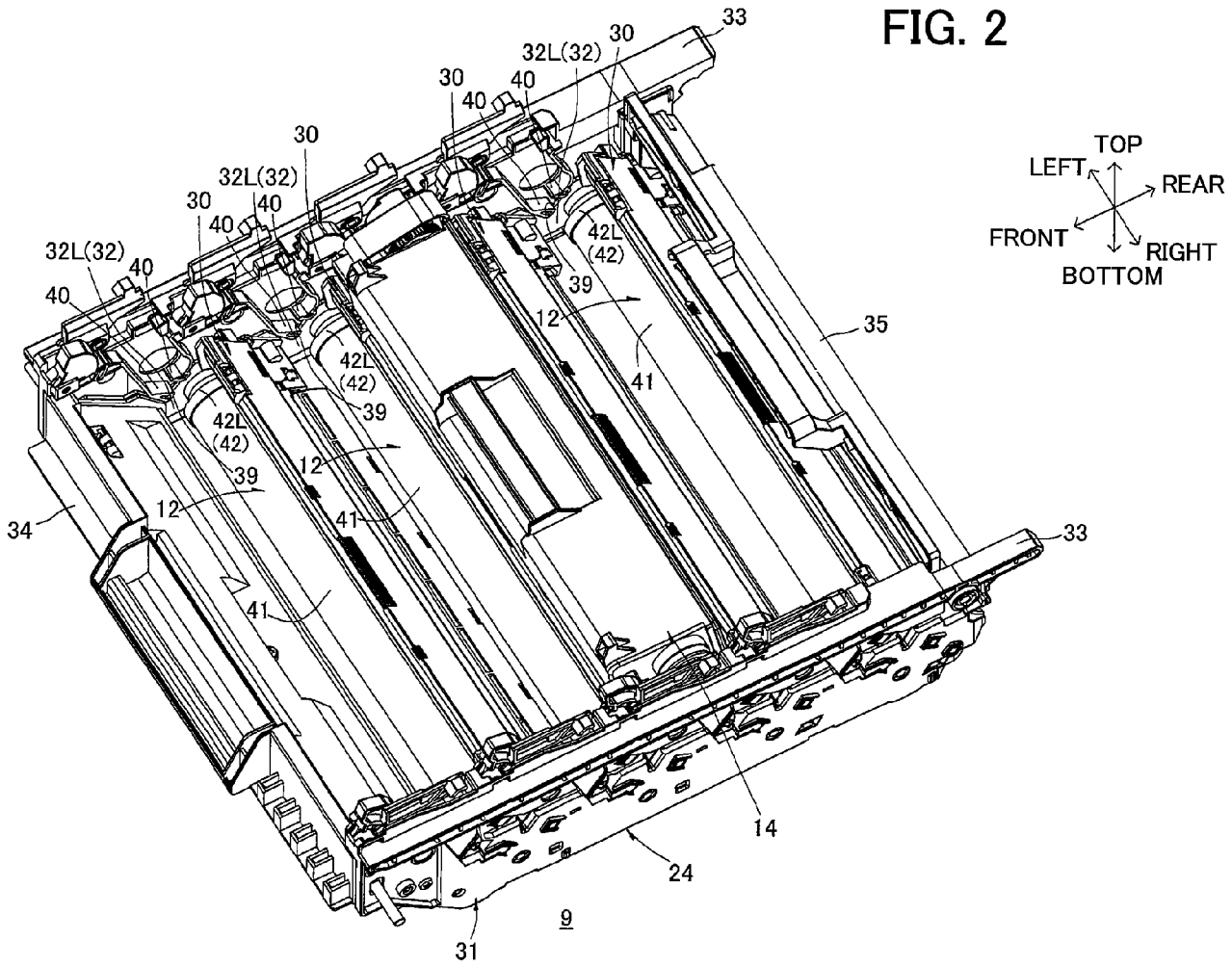
FIG. 2 is a perspective view of the process unit shown in FIG. 1 when viewed from upper-front side.
Figure 3:
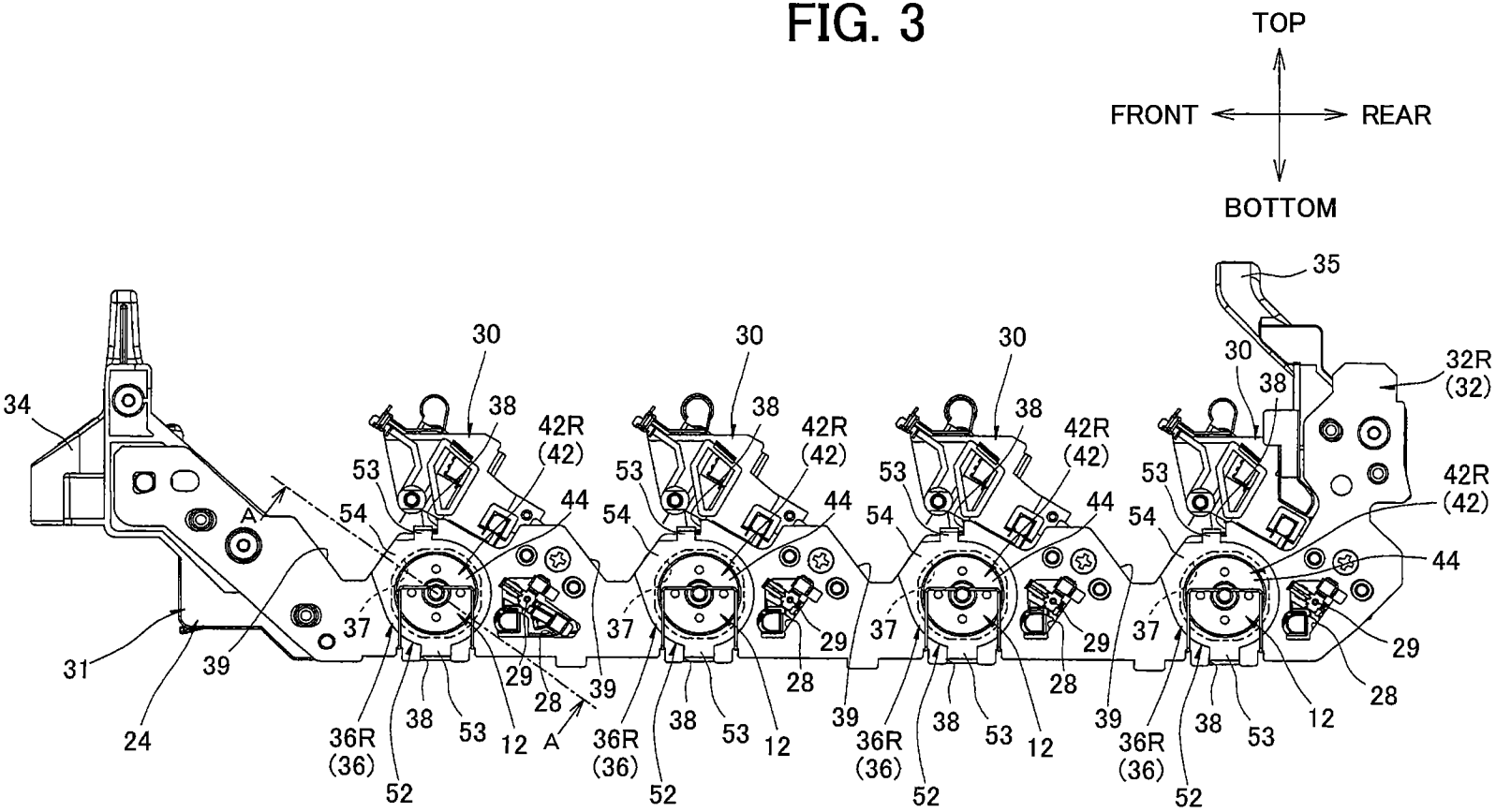
FIG. 3 is a right side view of the process unit from which a pair of outer side plates is removed.

As shown in FIGS. 2 and 3, the drum unit 24 includes a frame body 31, the four photosensitive drums 12, four pairs of bearing members 36, and four drum sub-units 30.

(1) Frame Body

The frame body 31 includes a pair of inner side plates 32, a pair of outer side plates 33, a front beam 34, and a rear beam 35.

Throughout the description, a right inner side plate and a left inner side plate will be designated as "32R" and "32L" respectively, if the inner side plates 32 will be referred in connection with lateral direction, i.e., rightward/leftward direction.

Each inner side plate 32 extends in frontward/rearward direction and is rectangular shaped in side view. These side plates 32 are produced by punching and pressing a metal plate using an identical punching press die. The inner side plates 32 confront each other and are spaced away from each other in lateral direction, i.e., in an axial direction of the photosensitive drum 12. More specifically, each inner side plate 32 is formed with drum support holes 37 (described later), and the drum support holes 37 of the right side plate 32R are in alignment with the drum support holes 37 of the left side plate 32L in lateral direction to support the photosensitive drums 12 through these holes 37.

Each inner side plate 32 is formed with the four drum support holes 37 and four cleaning electrode exposure holes 28, and is provided with four pairs of bearing engagement portions 38 and guide rib fitting portions 39.

The four drum support holes 37 have generally circular shape and are arrayed in the frontward/rearward direction with a constant interval.

Each pair of bearing engagement portion 38 includes an upper engagement portion provided at an upper edge of the inner side plate 32 and a lower engagement portion provided at a lower edge of the inner side plate 32, so that each drum support hole 37 is positioned between the upper and lower engagement portions in vertical direction.

The upper engagement portion 38 is in the formed of a rectangular shaped notch notched downward from an upper edge of the inner side plate 32 to a position above an upper end of the drum support hole 37.

The lower engagement portion 38 is in the formed of a rectangular shaped notch notched upward from a lower edge of the inner side plate 32 to a position below a lower end of the drum support hole 37.

Each guide rib fitting portion 39 is in the form of a V-shaped notch positioned diagonally upward and frontward of each drum support hole 37. Each guide rib fitting portion 39 is notched downward from the upper edge of the inner side plate 32 to a generally intermediate portion of the inner side plate 32 in vertical direction.

Each cleaning electrode exposure hole 28 is positioned rearward of each drum support hole 37 and extends through a thickness of the inner side plate 32, and has a generally rectangular shape.

As shown in FIG. 2, each outer side plate 33 is generally rectangular shaped having a vertical length greater than that of the inner side plate 32, and a frontward/rearward length approximately equal to that of the inner side plate 32. Each outer side plate 33 is positioned at laterally outer side of the inner side plate 32 and in contact therewith.

Each outer side plate 33 is provided with four pairs of guide ribs 40 for guiding lateral end portions of the four developing roller 15. Each pair of guide ribs 40 includes a front guide rib and a rear guide rib.

Each pair of guide ribs 40 extends in vertical direction, and protrudes laterally inwardly from a laterally inner surface of each outer side plate 33. The pair of guide ribs 40 is spaced away from each other in the frontward/rearward direction. Further, each lower end portion of each pair of guide ribs 40 is spaced away from each other by a distance slightly greater than a diameter of a rotation shaft of the developing roller 15, and extends diagonally downward and rearward to be fitted with each guide rib fitting portion 39 of the inner side plate 32 from above.

The front beam 34 is spanned between the front end portions of the inner side plates 32. The rear beam 35 is spanned between the rear end portions of the inner side plate 32.

(2) Photosensitive Drum

Figure 4:
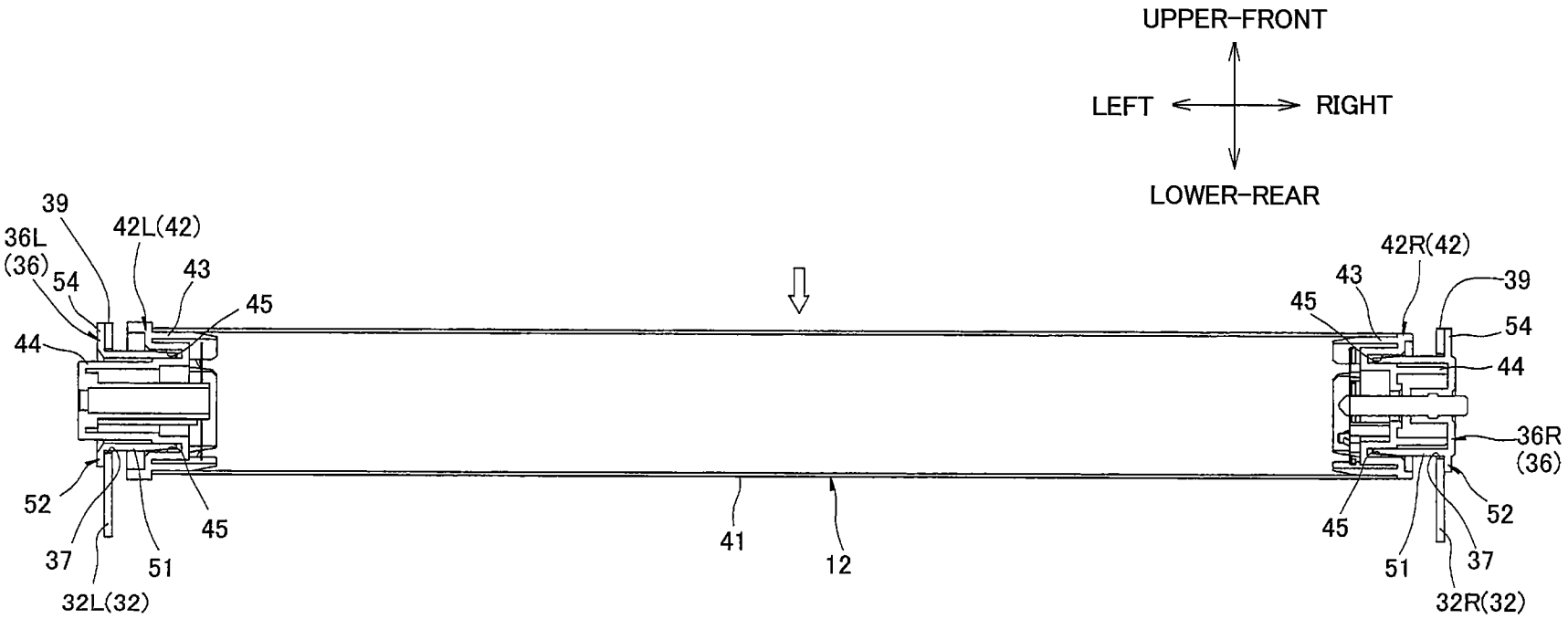
FIG. 4 is a cross-sectional view of the process unit shown in FIG. 1.

As shown in FIG. 4, each photosensitive drum 12 includes a tubular body 41 made from a metal, and a pair of fitting members 42.

In the following description, right side fitting member and left side flange member will be designated as "42R" and "42L", respectively when these fitting members 42 will be referred in connection with lateral direction.

The metallic tubular body 41 extends in lateral direction and is hollow cylindrical shaped.

Each fitting member 42 is fitted with each lateral end portion of the tubular body 41 avoiding relative rotation therebetween. Each fitting member 42 includes a drum fitting portion 43 inserted into the tubular body 41, and a bearing fitting portion 44 supported by the bearing member 36.

The drum fitting portion 43 has a generally cylindrical shape whose outer diameter is approximately equal to an inner diameter of the tubular body 41. The drum fitting portion 43 has a receiving portion 45 for receiving therein each laterally inner end portion of each sleeve portion 51 (described later) of each bearing portion 36.

Each receiving portion 45 is formed with an annular recess recessed laterally inward from a laterally outer end portion of the drum fitting portion 43 such that an axis of the drum fitting portion 43 is coincident with an axis of the annular recess. The recess has a radially inner side peripheral surface whose diameter is slightly greater than an outer diameter of the bearing fitting portion 44.

Further, the annular recess defines a width between the radially inner side peripheral surface and a radially outer side peripheral surface, the width being greater than a thickness of the sleeve portion 51 of the bearing member 36.

The bearing fitting portion 44 extends laterally outward from the drum fitting portion 43, and is generally cylindrical shaped whose outer diameter is smaller than an inner diameter of the drum support hole 37. The bearing fitting portion 44 is coaxial with the drum fitting portion 43.

The bearing fitting portion 44 of the right flange portion 42R has a rightmost open end portion, whereas the bearing fitting portion 44 of the left flange portion 42L has a closed leftmost end portion.

The leftmost end portion of the left flange portion 42L is formed with a coupling fitting hole (not shown) so that a fitting protrusion (not shown) of a male coupling member (not shown) provided in the main casing 2 can be fitted with the fitting hole.

(3) Bearing Member

Each bearing member 36 is supported to each inner side plate 32 avoiding relative rotation therebetween, and is configured to rotatably support each lateral end portion of each photosensitive drum 12.

In the following description, right and left bearing members 36 will be designated as "36R" and "36L" respectively.

Figure 5:
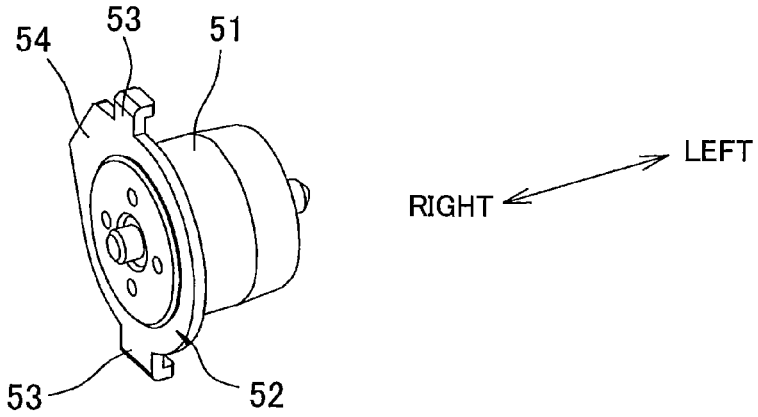
FIG. 5 is a perspective view of a right and left bearing members shown in FIG. 4 when viewed from right side.
Figure 5:
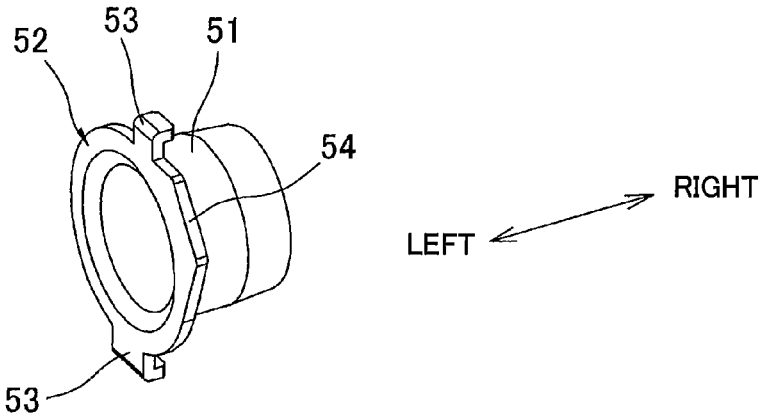

As shown in FIGS. 4 and 5, each bearing member 36 is integrally provided with the sleeve portion 51 and a flange portion 52.

The sleeve portion 51 extends in lateral direction and is generally cylindrical shaped. The sleeve portion 51 has an outer diameter slightly smaller than the inner diameter of the drum support hole 37. Further, the sleeve portion 51 has an inner diameter larger than an outer diameter of the bearing fitting portion 44, so that the bearing fitting portion 44 is loosely fitted with or rotatable relative to the sleeve portion 51.

The sleeve portion 51 of the right bearing member 36R has an open leftmost end and has a closed rightmost end, whereas the sleeve portion 51 of the left bearing member 36L has an open leftmost end and an open rightmost end.

The flange portion 52 protrudes radially outwardly from each laterally outer end portion of each sleeve portion 51 to form an annular disc shape. The flange portion 52 is provided with a pair of engagement portions 53 and an extension portion 54.

The engagement portions 53 are provided at diametrically opposite sides of the flange portion 52, such that one engagement portion 53 is positioned at an upper end of the flange portion 52 and the other engagement portion 53 is positioned at a lower end of the flange portion 52 when the bearing member 36 is assembled to the inner side plate 32. Each engagement portion 53 is plate shaped and bent into L-shape. More specifically, each engagement portion 53 has a base end portion extending from each flange portion 52 radially outwardly, and has a bent portion bent from the base end portion toward laterally inner side.

The extension portion 54 protrudes radially outwardly from the radially outer end portion of the flange portion 52 and is generally trapezoidal shaped. The extension portion 54 extends from the flange portion 52 in upward/frontward direction when the bearing member 36 is assembled to the inner side plate 32. The extension portion 54 corresponds to the reinforcing portion.

Each bearing member 36 is attached to the inner side plate 32 from laterally outer side of the inner side plate 32. Upon completion of attachment, the sleeve portion 52 is inserted into the drum support hole 37 and the engagement portions 53 are engaged with the bearing engagement portions 38.

Further, in this state, the bearing fitting portion 44 and the sleeve portion 51 are relatively rotatable.

(4) Drum Sub-Unit

As shown in FIG. 2, four drum sub-units 30 are positioned between the inner side plates 32 and between the front beam 34 and the rear beam 35, and are arrayed in frontward/rearward direction at a constant interval. Each drum sub-unit 30 is positioned rearward of each photosensitive drum 12.

Each drum sub-unit 30 extends in lateral direction and has a triangular prism shape. The Scorotron charger 13 and the drum cleaning roller 25 arrayed in the lateral direction are held to each drum sub-unit 30.

As shown in FIG. 3, each drum sub-unit 30 has a right end portion provided with a cleaning electrode 29 electrically connected to each drum cleaning roller 25. The cleaning electrode 29 is bent plate shaped, and protrudes laterally outward from the inner side plate 32 through the cleaning electrode exposure hole 28.

(5) Assembling Drum Unit

Assembling manner of the drum unit 24 will next be described with reference to FIGS. 4 and 5.

First, the drum sub-units 30, the front beam 34, and the rear beam 35 are positioned between the pair of inner side plates 32 and are attached thereto.

More specifically, each drum sub-unit 30 is fixed to the inner side plates by screws at a predetermined position.

Simultaneously, the front beam 34 and the rear beam 35 are attached to the pair of inner side plates 32.

Then, each photosensitive drum 12 is supported to the pair of inner side plates 32.

More specifically, the bearing member 36 is attached to the fitting member 42, while the bearing fitting portion 44 of the fitting member 42 is inserted into the drum support hole 37 from laterally inner side of the inner side plate 32.

For the attachment of the bearing member 36 to the fitting member 42, the bearing member 36 is positioned at laterally outer side of the inner side plate 32 such that laterally inner end portion of the sleeve portion 51 is in confrontation with the laterally outer end portion of the bearing fitting portion 44. Then, the bearing fitting portion 44 is inserted into the sleeve portion 51 and laterally inner end portion of the sleeve portion 51 is inserted into the annular recess of the receiving portion 45.

Thus, the laterally inner end portion of the sleeve portion 51 of the bearing member 36 is rotatably (loosely) fitted with the receiving portion 45 of the fitting member 42 at a position laterally inward from the lateral end portion of the tubular body 41 of the photosensitive drum 12. The laterally inner end portion of the sleeve portion 51 of the bearing member 36 corresponds to the protruding portion of the present invention.

In this case, the inner peripheral surface of the sleeve portion 51 is slightly spaced away from the outer peripheral surface of the bearing fitting portion 44. In other words, the laterally inner end portion of the sleeve portion 51 is loosely fitted with the annular recess of the receiving portion 45. Therefore, the fitting member 42 is rotatable relative to the bearing member 36.

The engagement portion 53 of the bearing member 36 is engaged with the bearing engagement portion 38. In this case, the extension portion 54 extends diagonally upward and frontward of the flange portion 52. By this engagement, the bearing member 36 is fixed to the inner side plate avoiding rotation of the bearing member 36 with respect to the inner side plate 32. Consequently, the photosensitive drum 12 can be assembled to the inner side plates 32.

Upon completion of assembly, the bearing member 36 is supported to the inner side plate 32 at the laterally outer end portion of the sleeve portion 51. The laterally outer end portion of the sleeve portion 51 corresponds to the supported portion of the present invention. Further, laterally inner side surface of the flange portion 52 is in contact with the laterally outer surface of the inner side plate 32.

After all photosensitive drums 12 are assembled to the inner side plates 32, the outer side plates 33 are attached to the inner side plates 32 from laterally outward, and the front beam 34 and the rear beam 35 are fixed to the outer side plates 33 by screws.

Thus, the assembly of the drum unit 24 is completed.

3. Function of Bearing Members

Next, the function of the bearing member 36 will be described while referring to FIG. 4.

When the photosensitive drum 12 is pressed diagonally downward and rearward by the developing roller 15 as indicated by an arrow shown in FIG. 4, the left end portion of the sleeve portion 51 of the right bearing member 36R and the right end portion of the sleeve portion 51 of the left bearing member 36L are bent diagonally downward and rearward.

However, the sleeve portion 51 is inserted into the receiving portion 45. In other words, the sleeve portion 51 is disposed at a position laterally inward from the distal end of the metallic tubular body 41.

Therefore, the photosensitive drum 12 is displaced diagonally downward and rearward while the axis of the tubular body 41 and the axis of the fitting members 42 are coincident with each other. Thus, coaxial relationship between the tubular body 41 and the fitting members 42 can be maintained during the displacement of the photosensitive drum 12 irrespective of pressure application to the photosensitive drum 12 from the developing roller 15.

Further, due to the bending of the sleeve portions 51, the upper end portion of the bearing member 36 is urged laterally inwardly, whereas the lower end portion of the bearing member 36 is urged laterally outwardly.

However, since the extension portion 54 extending upward from the upper end portion of the flange portion 52 is pressed against the laterally outer surface of the inner side plate 32, such urging force can be received by the extension portion 52 that can sustain the urging force.

Consequently, the deformation of the bearing member 36 can be reduced, and as a result, diagonally downward and rearward displacement of the photosensitive drum 12 can be reduced.

4. Effect

As described above, each bearing member 36 is rotatably fitted with the fitting member 42 at the position laterally inward from the lateral end of the tubular body 41 as shown in FIG. 4.

Therefore, bending of the bearing member 36 occurs upon application of pressure to the photosensitive drum 12 from the developing roller 15, restraining displacement of the axis of the tubular body 41 from the axis of the fitting member 42, and stabilizingly supporting each lateral end portion of the tubular body 41 by the drum fitting portion 43 of the fitting member 42.

As a result, bending of the each fitting member 42 can be prevented irrespective of the application of pressure to the photosensitive drum 12 from the developing roller 15, thereby rotating the tubular body 41 at high accuracy.

Further, as shown in FIG. 4, each laterally inner end portion of each sleeve portion 51 of each bearing member 36 is fitted with the annular recess 45 of the drum fitting portion 43 of the fitting member 42. Therefore, the bearing member 36 can be fitted with the fitting member 42 at the position laterally inward from the lateral end portion of the tubular body 41.

Further, the extension portion 54 is formed on the upper front portion of the flange portion 52. Therefore, the upper front portion of the flange portion 52 can be reinforced by the extension portion 54, to further avoid bending of the bearing member 36 with a simple construction.

Further, as shown in FIG. 1, the photosensitive drum 12 is pressed by the developing roller 15. Therefore, the above-described structure can efficiently reduce displacement of the photosensitive drum 12 in the pressing direction attendant to the developing roller 15.

Further, the cleaning electrode 29 is provided at the rear side of the flange portion 52 of the right bearing member 36 for applying bias voltage to the drum cleaning roller 25. Therefore, efficient layout of the cleaning electrode 29 can be attained while reducing the displacement of the photosensitive drum 12.

Further, each photosensitive drum 12 can be integrally supported to the inner side plates 32 such that the drums 12 are arrayed in the frontward/rearward direction as shown in FIG. 2. Therefore, bending of each fitting member 42 can be prevented at each photosensitive drum 12, thereby enabling rotation of the tubular body 41 at high accuracy.

Thus, the color printer 1 provided with the above-described process unit 9 can realize stable rotation of the tubular body 41, thereby stabilizing image forming operation.

5. Second Embodiment

Figure 6:
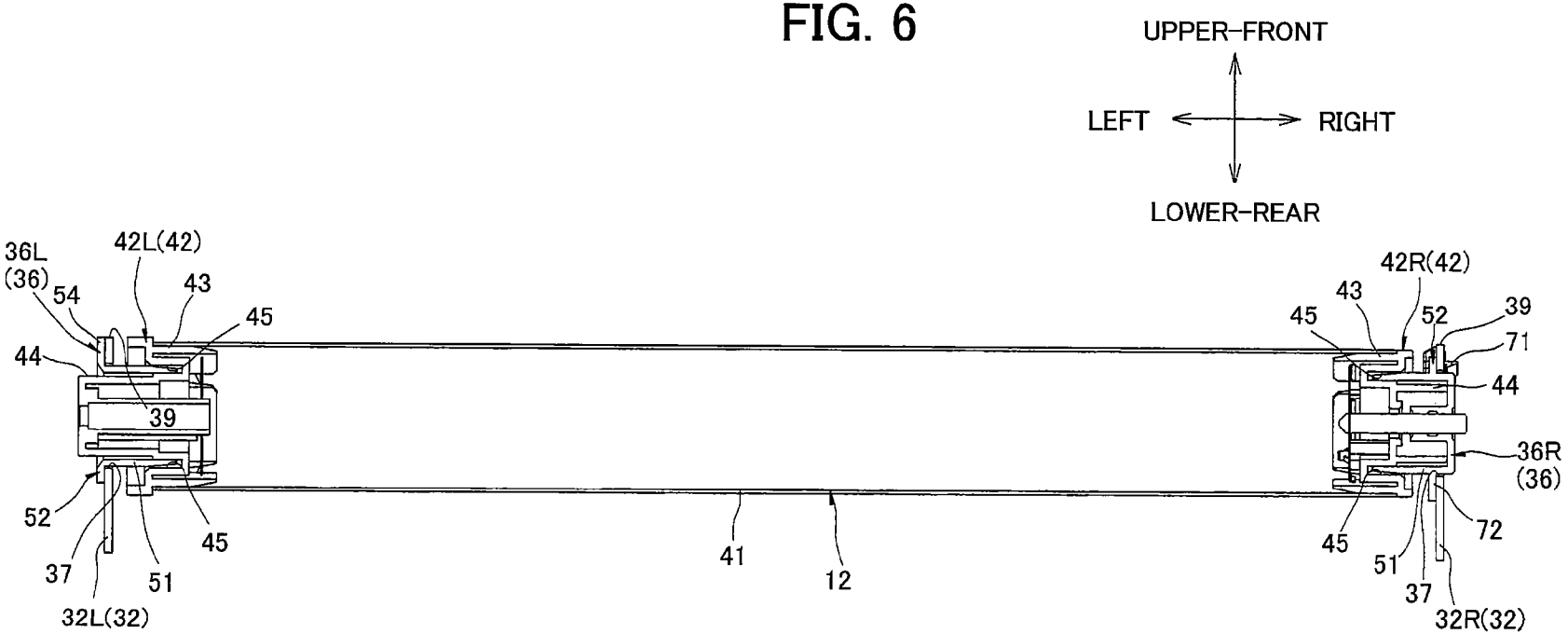
FIG. 6 is a cross-sectional view of a main section of a process unit according to a second embodiment.
Figure 7:
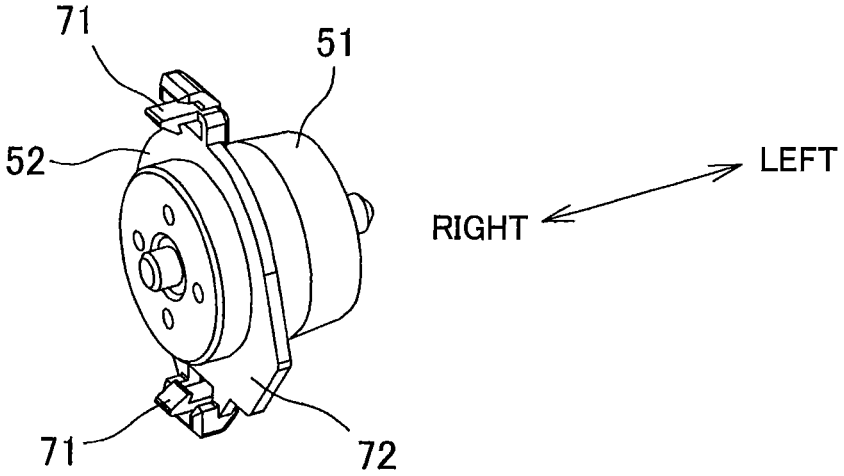
FIG. 7 is a perspective view of a right bearing member shown in FIG. 6 when viewed from right side.

A process unit according to a second embodiment will be described with reference to FIGS. 6 and 7, wherein like parts and components are designated by the same reference numerals as those shown in FIGS. 1 through 5. According to the first embodiment, each bearing member 36 is assembled to the right inner side plate 32 from laterally outer side of the inner side plate 32. On the other hand, in the second embodiment, the right bearing member 36R is assembled to the right inner side plate 32R from laterally inner side of the inner side plate 32R, whereas the left bearing member 36L is assembled to the left inner side plate 32L from laterally outer side thereof.

The right bearing member 36R has a flange portion 52 provided with a pair of engagement portions 71 and an extension portion 72.

The engagement portions 71 are provided at diametrically opposite sides of the flange portion 52, such that one engagement portion 71 is positioned at an upper end of the flange portion 52 and the other engagement portion 71 is positioned at a lower end of the flange portion 52 when the right bearing member 36R is assembled to the right inner side plate 32R. Each engagement portion 71 is plate shaped and bent into L-shape. More specifically, each engagement portion 71 has a base end portion extending from each flange portion 52 radially outwardly, and has a bent portion bent from the base end portion toward laterally outer side. The bent portion has a free end portion provided with a hooked portion.

The extension portion 72 protrudes radially outwardly from the radially outer end portion of the flange portion 52 and is generally trapezoidal shaped. The extension portion 72 is positioned at rear-bottom side of the flange portion 52 when the bearing member 36 is assembled to the inner side plate 32.

For assembling the photosensitive drum 12 to the pair of inner side plates 32, firstly, the photosensitive drum 12 is attached to the right inner side plate 32R.

To achieve this attachment, the right bearing member 36R is positioned at right side of the right fitting member 42R in such a manner that the left end portion of the sleeve portion 51 of the right bearing member 36 is in confrontation with the right end portion of the bearing fitting portion 44 of the right fitting member 42R. Then, the bearing fitting portion 44 of the right fitting member 42R is inserted into the sleeve portion 51 of the right bearing member 36R, and the left end portion of the sleeve portion 51 of the right bearing member 36 is fitted with the annular recess 45 of the right fitting member 42R.

Thus, the left end portion of the sleeve portion 51 of the right bearing member 36R is rotatably fitted with the annular recess 45 of the right fitting member 42R at a position laterally inward of the right end portion of the tubular body 41. The left end portion of the sleeve portion 51 of the right bearing member 36R fitted with the annular recess 45.

In this case, an inner peripheral surface of the sleeve portion 51 is slightly spaced away from an outer peripheral surface of the bearing fitting portion 44 of the right fitting member 42, so that the right fitting member 42R is rotatable relative to the right bearing member 36R at the drum fitting portion 43.

Then, the photosensitive drum 12 is positioned relative to the laterally inner side of the right inner side plate 32R in such a manner that right end portion of the sleeve portion 51 of the right bearing member 36R is in confrontation with the left side of the drum support hole 37, and the photosensitive drum 12 is attached to the right inner side plate 32R by inserting the sleeve portion 51 of the right bearing member 36R into the drum support hole 37.

Simultaneously, the engagement portions 71 of the right bearing member 36R are engaged with the bearing engagement portions 38 of the right inner side plate 32R while orienting the extension portion 72 diagonally downward and rearward. Thus, the right bearing member 36R is fixed to the right inner side plate 32R avoiding relative rotation therebetween, completing attachment of the photosensitive drum 12 to the right inner side plate 32R.

In this case, the right end portion of the right bearing member 36R is supported to the right inner side plate 32R. The right end portion functions as a supported portion supported to the right inner side plate 32R. Further, the right side surface of the flange portion 52 of the right bearing member 36R is in contact with the laterally inner side surface of the right inner side plate 32R.

Then, the photosensitive drum 12 is attached to the left inner side plate 32L in a manner similar to the first embodiment. Thus, the photosensitive drum 12 is supported by the pair of inner side plates 32.

As described above according to the second embodiment, the right bearing member 36R includes the extension portion 72 extending diagonally downward and rearward from the lower end portion of the flange portion 52, and contacting with the left side surface of the right inner side plate 32R.

Therefore, a laterally outward force applied to the right bearing member 36R can be received by the abutment between the extension portion 72 and the left side surface of the right inner side plate 32R.

Accordingly, the second embodiment performs its function the same as that of the first embodiment.

6. Third Embodiment

Figure 8:
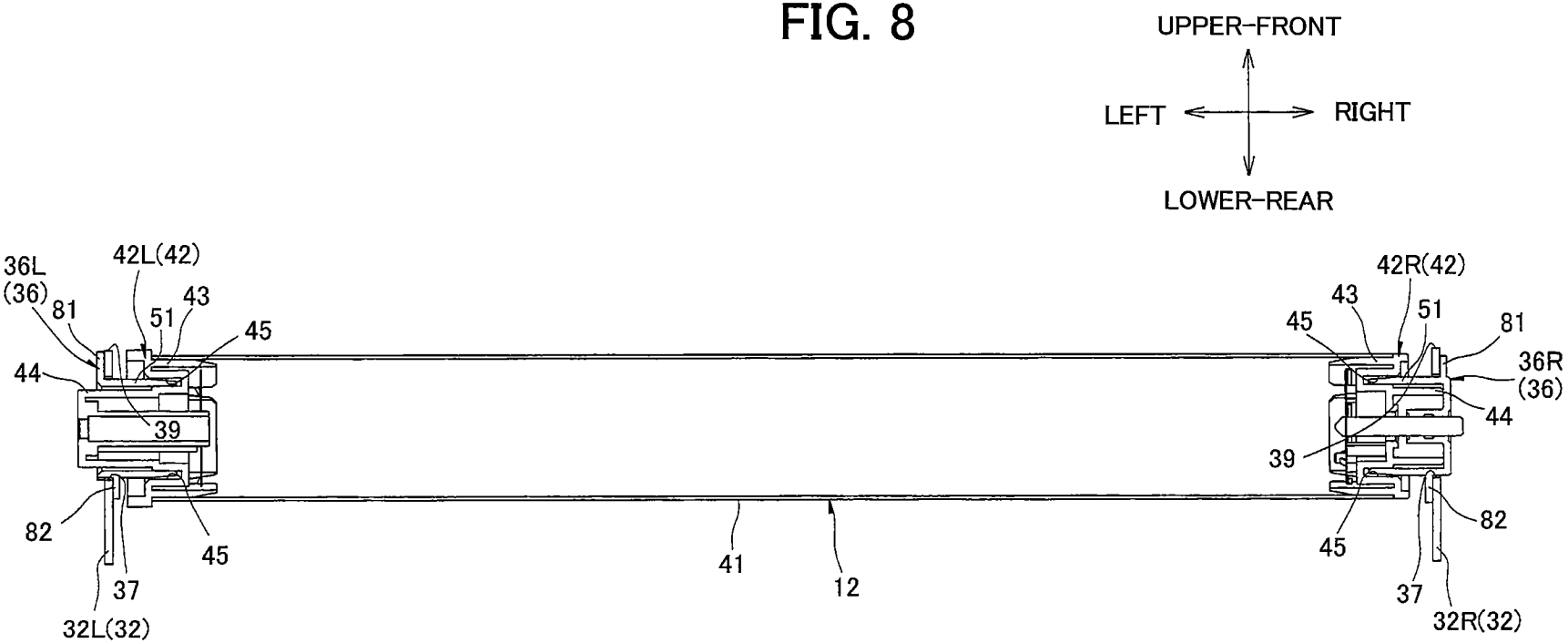
FIG. 8 is a cross-sectional view of a main section of a process unit according to a third embodiment.
Figure 9:
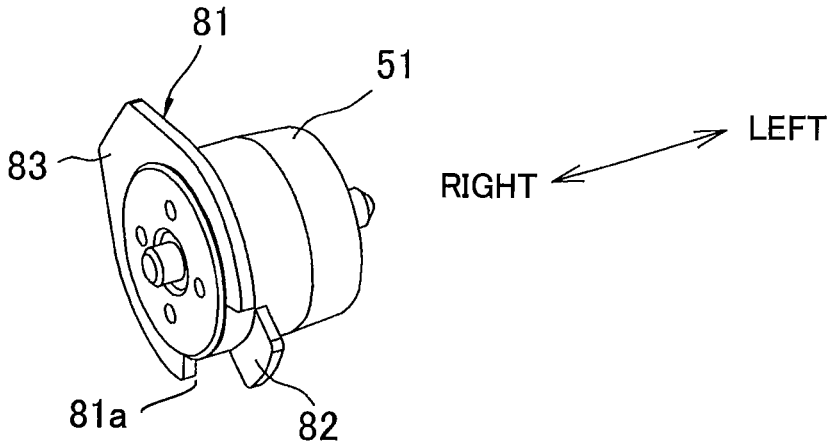
FIG. 9 is a perspective view of a right and left bearing members shown in FIG. 8 when viewed from right side.
Figure 9:
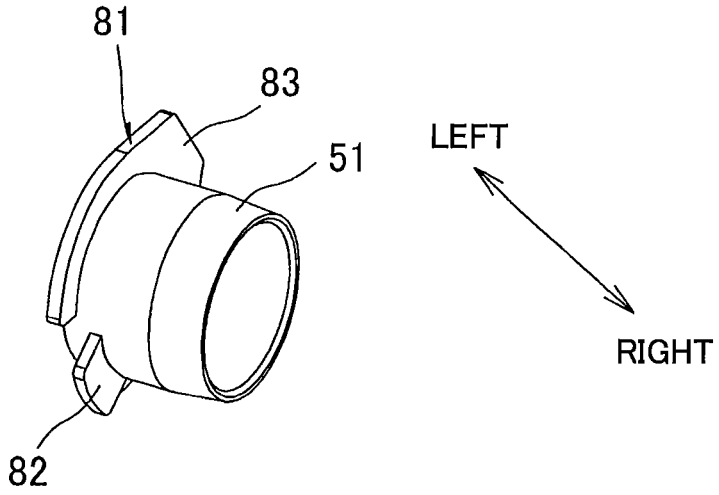

FIGS. 8 through 9(*b*) show a color printer according to a third embodiment of the present invention, wherein like parts and components are designated by the same reference numerals as those shown in FIGS. 1 through 5. According to the third embodiment, an outer flange portion 81 and an inner flange portion 82 are provided. The outer flange portion 81 is in contact with a laterally outer side surface of the inner side plate 32, and the inner flange portion 81 is in contact with a laterally inner side surface of the inner side plate 32.

More specifically, as shown in FIGS. 9(*a*) and 9(*b*), the outer flange portion 81 protrudes from a laterally outer end portion of the sleeve portion 51, and has an annular disc like shape with a partly cut-away portion 81*a*.

Further, an outer extension portion 83 extends radially outwardly from the outer flange portion 81 at a diametrically opposite side of the cut-away portion 81*a*. The outer extension portion 83 is trapezoidal shaped.

The inner flange portion 82 is positioned in alignment with the cut-away portion 81*a* of the outer flange portion 81 in lateral direction. The inner flange portion 82 protrudes radially outwardly from the sleeve portion 51 at a position laterally inward of the outer flange portion 81, and has a generally rectangular shape.

The inner flange portion 82 is spaced away from the outer flange portion 81 in the lateral direction by a distance approximately equal to or slightly larger than the thickness of the inner side plate 32.

Further, the inner flange portion 82 has a radially protruding length greater than that of the outer flange portion 81 other than a portion including the outer extension portion 83. Each inner side plate 32 is formed with a notched portion (not shown) allowing the inner flange portion 82 to pass therethrough.

For attaching the photosensitive drum 12 to the pair of inner side plates 32, each bearing member 36 is attached to each bearing fitting portion 44 of the fitting member 44, while each bearing fitting portion 44 is inserted into each drum support hole 37.

More specifically, the each bearing member 36 is positioned at laterally outer side of each inner side plate 32 in such a manner that each laterally inner end portion of each sleeve portion 51 is in confrontation with each laterally outer end portion of each bearing fitting portion 44 of the fitting member 42. Then, each bearing fitting portion 44 of the fitting member 42 is inserted into each sleeve portion 51, and each laterally inner end portion of each sleeve portion 51 is fitted with each annular recess 45 of the fitting member 42.

In this case, each inner flange portion 82 passes through each notched portion (not shown) formed in each inner side plate 32, so that the inner flange portion 82 can be positioned laterally inward of the inner side plate 32.

Then, the bearing member 36 is angularly rotated so as to direct the outer extension portion 83 can be oriented diagonally upward and frontward and the inner flange portion 82 can be oriented diagonally downward and rearward. By this angular rotation, the inner flange portion 82 can be displaced from the notched portion (not shown). Thus, assembly of the photosensitive drum 12 to the inner side plates 32 can be completed.

Incidentally, stop portions (not shown) are provided for fixing the above-mentioned orientation of the outer extension portion 83 and the inner flange portion 82.

In this case, the laterally inner side surface of the outer flange portion 81 is in contact with the laterally outer side surface of the inner side plate 32, and the laterally outer side surface of the inner flange portion 82 is in contact with the laterally inner side surface of the inner side plate 32.

With this structure, the outer extension portion 83 is imparted with laterally inward force, and the inner flange portion 82 is imparted with laterally outward force.

Therefore, bending of the bearing member 36 can be reduced, thereby reducing displacement of the photosensitive drum 12.

Further, the third embodiment performs function the same as that of the first embodiment.

7. Modifications

While the invention has been described in detail with reference to the embodiments thereof, it would be apparent to those skilled in the art that various changes and modifications may be made therein without departing from the spirit of the invention.

Figure 10:
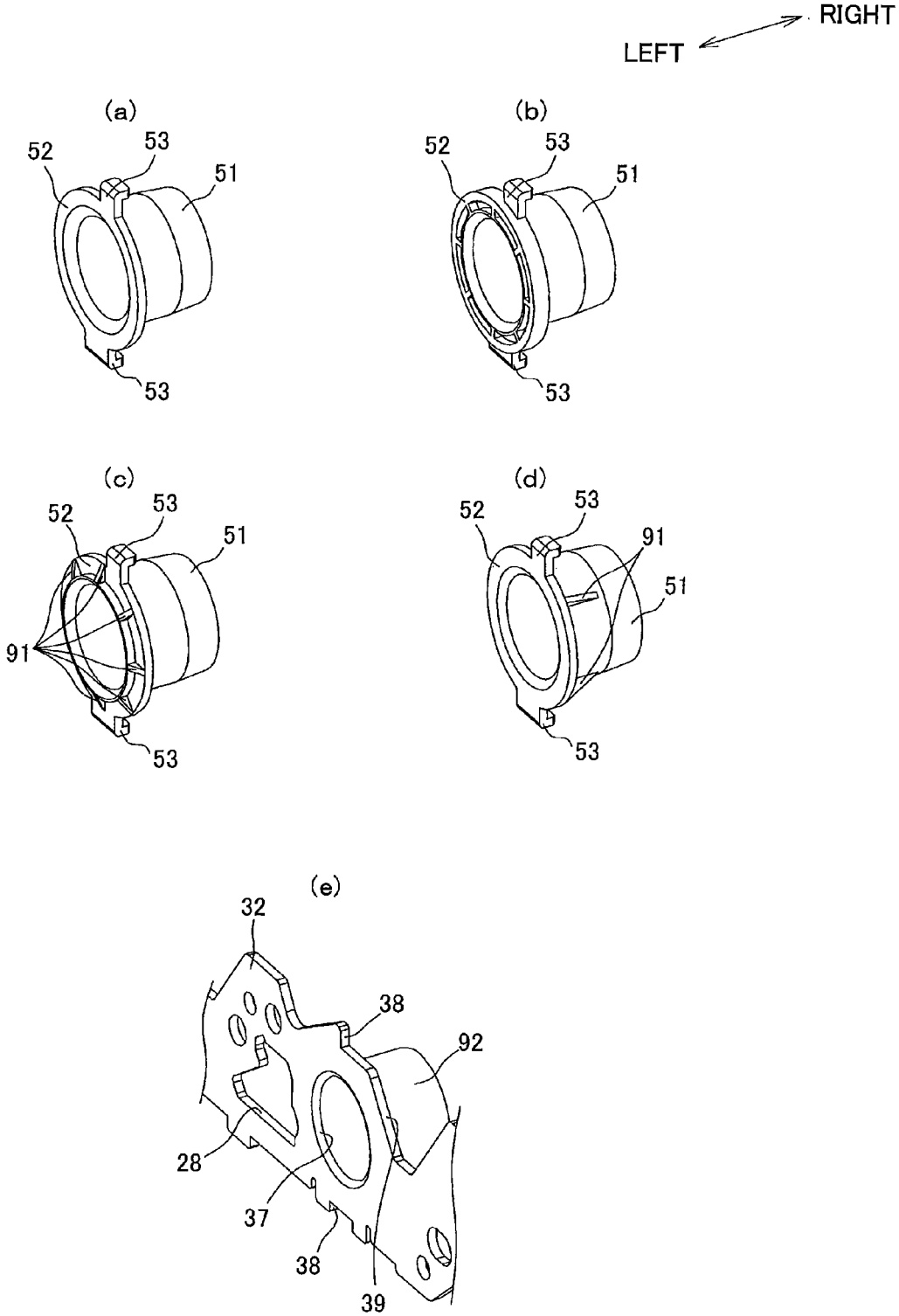
FIG. 10 shows left bearing members according to modifications of the present invention.

FIG. 10(*a*) shows a first modification to the bearing member where the extension portion 54 is dispensed with the flange portion 52. Certain advantage similar to the first embodiment can be obtained in the first modification.

FIG. 10(*b*) shows a second modification to the bearing member where a flange portion 52 has a thickness greater than a thickness of the flange portion 52 according to the above embodiments for reinforcing purpose. The thickness of the flange portion 452 is greater than that of the sleeve portion 51. The second modification does not have the extension portion 54 similar to the first modification.

FIG. 10(*c*) shows a third modification to the bearing member in which a flange portion 52 is not positioned at laterally endmost portion of the sleeve member 51, but is positioned slightly inward from the laterally endmost portion. Further, a plurality of ribs 91 are spanned between the laterally outer side surface of the flange portion 52 and an outer peripheral surface of the endmost portion of the sleeve member 51 for reinforcing the flange portion 52. The ribs 91 are spaced away from each other in a circumferential direction of the sleeve portion 551 and protrude radially outward therefrom.

FIG. 10(*d*) shows a fourth modification to the bearing member in which a plurality of ribs 692 are spanned between the laterally inner side surface of the flange portion 652 and an outer surface of the sleeve portion 651. The ribs 691 are spaced away from each other in a circumferential direction of the sleeve portion 651 and protrude radially outward therefrom. Incidentally, fitting grooves are formed in the inner side plate so as to fit with the ribs 692 upon assembly. The second through fourth modifications provide functions the same as those of the first embodiment.

FIG. 10 (*e*) shows a fifth modification to the bearing member and the inner side plates. In the foregoing embodiments, the inner side plate 32 and the bearing member are separate from each other. On the other hand according to the fifth modification, a tubular portion 92 functioning as the bearing member is provided integrally with the inner side plate.

More specifically, the tubular portion 92 extends laterally inward from the inner side surface of the inner side plate 32 and has a base end surrounding the drum support hole 37. The tubular portion 92 is generally cylindrical shaped, and has an inner diameter equal to the diameter of the drum support hole 37. The bearing fitting portion 44 of the fitting member 42 is loosely fitted with the tubular portion 92.

For attaching the photosensitive drum 12 to the inner side plate 32, the photosensitive drum 12 is positioned at a position laterally inward of the inner side plates 32 in such a manner that each laterally inner end portion of the tubular portion 92 is in confrontation with each laterally outer end portion of the bearing fitting portion 44. Then, each bearing fitting portion 44 is inserted into each tubular portion 92, and each laterally inner end portion of the tubular portion 92 is fitted with the annular recess 45.

Thus, the annular recess 45 of the bearing fitting potion 44 is rotatably fitted with the laterally inner end portion of the tubular portion 92 at a position laterally inward from the lateral end portion of the tubular body 41. The laterally inner end portion of the tubular portion 92 functions as the protruding portion. The fifth modification performs the function the same as that of the first embodiment. Further, positioning accuracy of the photosensitive drum 12 relative to the inner side plate can be further improved because of the integral construction between the tubular portion 92 and the inner side plate 36.

Further, according to the first embodiment, each lateral end portion of the photosensitive drum 12 is supported to each inner side plate 32 through each bearing member 36. As a further modification, a right inner side plate is not formed with the drum support hole 37, and instead, a shaft extending laterally inward from an inner side surface of the right side plate is provided for rotatably supporting the right end portion of the photosensitive drum 12. The left end portion of the photosensitive drum 12 is supported to the drum support hole 37 of the left inner side plate through the left bearing member 36L.

As a further alternative, a left inner side plate is not formed with the drum support hole 37, and instead, a shaft extending laterally inward from an inner side surface of the left side plate is provided for rotatably supporting the left end portion of the photosensitive drum 12. The right end portion of the photosensitive drum 12 is supported to the drum support hole 37 of the right inner side plate through the right bearing member 36R. These alternatives can also perform function the same as that of the first embodiment.

What is claimed is:

1. A process unit comprising:

a photosensitive drum defining a direction parallel to an axial direction of the photosensitive drum, and comprising:

a tubular body having a first end portion containing a distal end; and a fitting member un-rotatably provided at the first end portion, the fitting member having a recessed portion recessed inward relative to the distal end in the direction;

a bearing member rotatably supporting the fitting member at a position inward of the distal end of the tubular body of the photosensitive drum in the direction; and a side plate configured to un-rotatably support the bearing member, wherein the bearing member includes a supported portion supported to the side plate and a protruding portion protruding from the supported portion inward in the direction, the protruding portion supporting the fitting member at the recessed portion.

2. The process unit as claimed in claim 1, further comprising a pressure member pressing the tubular body in a pressing direction, wherein the supported portion has a cylindrical shape defining a radial direction, and wherein the bearing member further includes a flange portion protruding radially outwardly from the supported portion and contacting the side plate, the flange portion having a mechanically reinforced portion confronting the pressing direction.

3. The process unit as claimed in claim 2, wherein the mechanically reinforced portion comprises an extension portion extending in the pressing direction from the flange portion.

4. The process unit as claimed in claim 3, wherein the flange portion comprises:

a first extension portion extending toward an upstream side in the pressing direction and in contact with an outer side surface of the side plate in the direction; and a second extension portion extending toward a downstream side in the pressing direction and in contact with an inner side surface of the side plate in the direction.

5. The process unit as claimed in claim 4, wherein the first extension portion and the second extension portion are spaced away from each other by a distance equal to a thickness of the side plate in the direction.

6. The process unit as claimed in claim 2, wherein the flange portion has a thickness greater than that of the protruding portion.

7. The process unit as claimed in claim 2, further comprising a rib spanning between the flange portion and the protruding portion.

8. The process unit as claimed in claim 2, wherein the pressure member comprises a developing agent carrying member that carries developing agent to be supplied to the photosensitive drum.

9. The process unit as claimed in claim 2, further comprising:

a cleaning member in contact with the photosensitive drum at a position opposite to the pressure member with respect to the photosensitive drum for cleaning a surface of the photosensitive drum; and an electrode electrically connected to the cleaning member to apply bias voltage to the cleaning member, the electrode being positioned downstream of the flange portion in the pressing direction.

10. The process unit as claimed in claim 1, wherein the bearing member is integral with the side plate.

11. The process unit as claimed in claim 1, wherein the side plate includes a first side plate and a second side plate confronting and spaced away from the first side plate in the direction; and wherein the photosensitive drum includes a plurality of drums each extending in the first direction perpendicular to an extending direction of the first side plate and the second side plate, and arrayed in the extending direction thereof, each drum being supported to the first side plate and the second side plate.

12. An image forming device comprising:

a main casing; and a process unit configured to be received in the main casing and comprising:

a photosensitive drum defining a direction parallel to an axial direction of the photosensitive drum, and comprising:

a tubular body having a first end portion containing a distal end; and a fitting member un-rotatably provided at the first end portion, the fitting member having a recessed portion recessed inward relative to the distal end in the direction;

a bearing member rotatably supporting the fitting member at a position inward of the distal end of the tubular body of the photosensitive drum in the direction; and a side plate configured to un-rotatably support the bearing member, wherein the bearing member includes a supported portion supported to the side plate and a protruding portion protruding from the supported portion inward in the direction, the protruding portion supporting the fitting member at the recessed portion.

* * * * *